United States Patent [19]

Canavesi

[11] Patent Number: 5,000,716

[45] Date of Patent: Mar. 19, 1991

[54] SPRING STEERING DEVICE FOR TOY CARS

[75] Inventor: Maurizio Canavesi, Milano, Italy

[73] Assignee: Polistil Generale Giocattoli S.p.A.

[21] Appl. No.: 353,653

[22] PCT Filed: May 19, 1987

[86] PCT No.: PCT/EP87/00263

§ 371 Date: May 19, 1988

§ 102(e) Date: May 19, 1988

[87] PCT Pub. No.: WO87/07172

PCT Pub. Date: Dec. 3, 1987

[30] Foreign Application Priority Data

May 23, 1986 [IT] Italy ..... 21968/86[U]

[51] Int. Cl.[5] ..... A63H 17/36; B60G 0/0

[52] U.S. Cl. ..... 446/468; 446/460; 280/94; 280/95.1

[58] Field of Search ..... 446/468, 469, 460, 465, 446/466, 454, 455, 456, 470, 471; 280/94, 95.1

[56] References Cited

U.S. PATENT DOCUMENTS

| | | | |
|---|---|---|---|
| 1,654,217 | 12/1927 | Hill | 280/94 X |
| 1,856,991 | 5/1932 | Franklin | 446/454 X |
| 2,688,821 | 9/1954 | Bunting | 446/454 X |
| 2,946,153 | 7/1960 | Ernst | 446/468 |
| 3,290,818 | 12/1966 | Mills | 446/468 |
| 3,474,564 | 10/1969 | Perryman | 446/468 |
| 3,635,304 | 1/1972 | Hills | 446/468 X |
| 4,741,718 | 5/1988 | Moolman | 446/471 X |
| 4,799,915 | 1/1989 | Lehmann et al. | 446/456 X |

FOREIGN PATENT DOCUMENTS

| | | | |
|---|---|---|---|
| 1902231 | 7/1970 | Fed. Rep. of Germany | 446/469 |
| 435525 | 5/1948 | Italy | 446/454 |

*Primary Examiner*—Robert A. Hafer
*Assistant Examiner*—D. Neal Muir
*Attorney, Agent, or Firm*—Sughrue, Mion, Zinn, Macpeak & Seas

[57] ABSTRACT

A steering device for a toy car has a steering system tie rod carrying, at opposing ends thereof, respective spindles adapted to support steerable wheels. Accordion-shaped springs are connected between the ends of the steering system tie rod and the corresponding spindles.

3 Claims, 1 Drawing Sheet

SPRING STEERING DEVICE FOR TOY CARS

TECHNICAL FIELD

This invention relates to a steering device for toy cars, of a type which comprises a tie rod having opposite ends connected mechanically to respective spindles.

BACKGROUND ART

In order to provide a desired steering action on the steerable wheels of a toy car by operating its steering wheel, it is conventional practice to use steering devices which comprise essentially a steering column, to which the steering wheel is attached, arranged to act on a tie rod or crossbar of the steering system; the tie rod is in turn connected, as by means of links or steering arms, to two steering knuckles, a steerable wheel being associated with either knuckles. These prior steering devices usually employ such coupling arrangements as screw-and-nut, gear segment, or rack-and-pinion mechanisms for linking the steering column to the tie rod.

In general, the tie rod is, in common with the steering knuckles for the steerable wheels, steering arms and wheel axles, a part of the well-known articulated quadrilateral steering arrangement.

Such prior steering systems exhibit, however, the well-recognized drawbacks of a complex design and construction, and involve highly accurate designing and manufacturing procedures for their several members; all this reflects in costs which are objectionably high in view of the product for which they are intended, namely toy cars.

In an effort to obviate such drawbacks, a further type of steering device has been proposed which also conforms with the aforementioned articulated quadrilateral principle.

That further type, as disclosed in Italian Patent of Industrial Invention No. 1096250, for example, comprises a steering system tie rod which is formed with weakening lines effective to define two parallel hinges intervening to the end portions and the middle portion of the tie rod. Said end portions form, on bending, the aforementioned steering arms for connection to the steering knuckles. The steering column acts at some intermediate location on the middle portion of the tie rod, in between the weakening lines.

While advantageous in more than one way, not even this latter conventional type of steering device is devoid of such drawbacks as overall vulnerability as is evinced, especially after prolonged use, by the occurrence of breakage and deformation due to the stresses brought into play be the steering action on the steerable wheels concentrating at the very weakening lines, that is in areas which have been slenderized and whose construction has become inherently more fragile.

Still another drawback is, moreover, that the assembly procedure for such a conventional steering device involves an additional step, since the end portions of the tie rod must be properly bent relatively to the tie rod prior to assembling to the bodywork of the toy car.

DISCLOSURE OF INVENTION

It is an object of this invention to provide a steering device for toy cars, which as such constructional and operational features as to overcome the cited prior drawbacks.

This object is achieved, according to the invention, by a steering device of the general type outlined above being characterized in that it comprises spring means mounted and operative between each of said opposing ends and a respective one of said spindles.

BRIEF DESCRIPTION OF DRAWINGS

Further features and the advantages of the invention will be more clearly understood from the following detailed description of a preferred embodiment thereof, given by way of illustration and not of limitation with reference to the accompanying drawings.

In the drawings.

BEST MODE OF CARRYING OUT THE INVENTION

Figure 1:
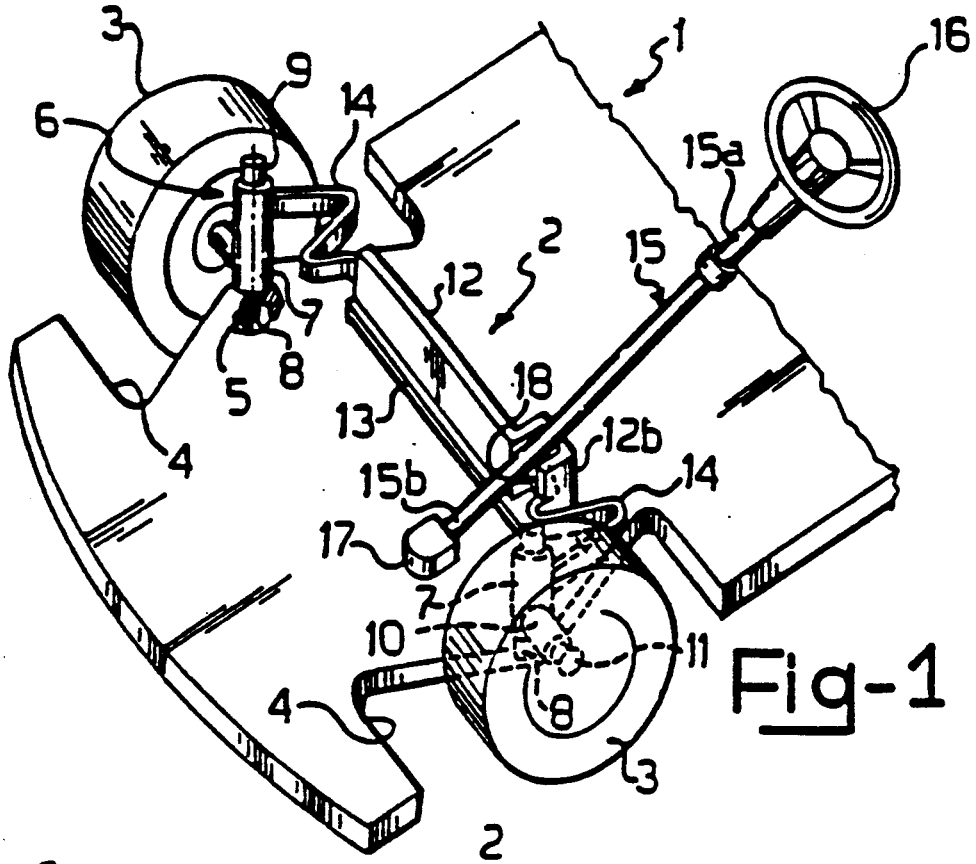
FIG. 1 is a perspective view showing diagramatically a steering device according to this invention as installed on the bodywork of a toy car.
Figure 2:
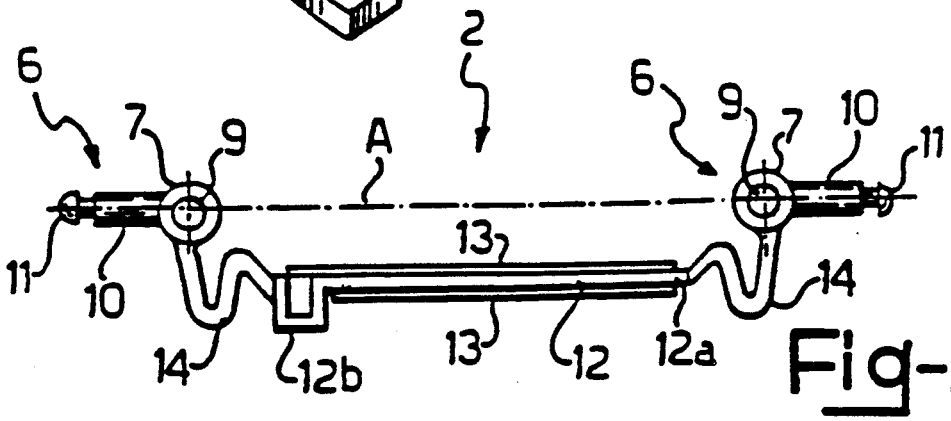
FIG. 2 is a detail plan of FIG. 1.
Figure 3:
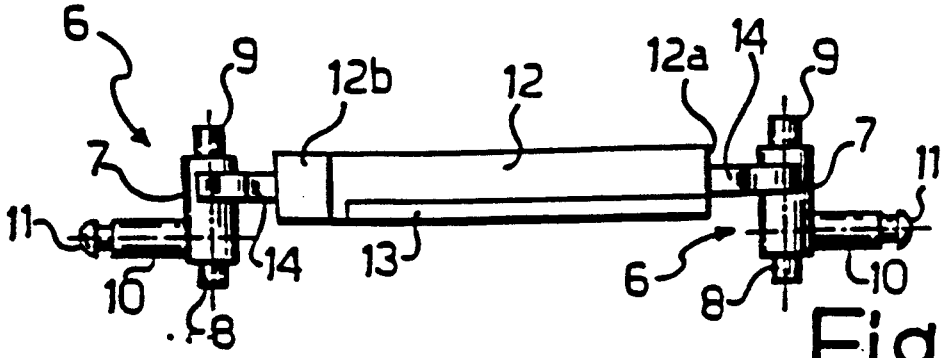
FIG. 3 is a an elevation view of the same detail as shown in FIG. 2.

With reference to the drawing figures, the numeral 1 denotes a bodywork of a toy car equipped with a steering device 2 according to the invention and effective to apply a preset steering effort to a pair of steerable front wheels 3, as will be explained hereinafter.

Two cutouts 4 are formed on the major sides 1*a* of the bodywork 1, the cutouts 4 being symmetrically opposed from each other and having larger dimensions than the steerable wheels 3. A hole 5 is formed respectively in the bodywork 1 proximate to each cutout 4.

The steering device 2 comprises two steering knuckles, or spindles, comprehensively designated 6, journalled on the bodywork 2; each steering knuckle 6 is made up of a cylindrical body 7 having a lower trunnion 8 and an upper trunnion 9 which are coaxial with each other and secured on the bottom and the top, respectively, of the cylindrical body 7. The bottom trunnions 8 fit into the holes 5 in the bodywork 1, while the upper trunnions 9 are adapted for engagement into holes likewise provided in a car body of the toy car, not shown because quite conventional.

Each steering knuckle or spindle 6 further comprises a respective stub shaft 10 attached at one end to the cylindrical body 7, and having its opposing end 11 formed with a mushroom termination.

The steering wheels 3 are mounted for free rotation about the stub shafts 10. The stub shafts 10 advantageously make a snap-action fit in the wheels 3 with their mushroom-shaped ends 11.

The steering device 2 includes a steering system tie rod 12 having opposing ends, indicated at 12*a* and 12*b*, and extending across the bodywork 1 in a parallel direction to a plane A lying perpendicularly to the bodywork 1 and containing the axes of the cylindrical bodies 7 of the steering knuckles 6; further, the ends 12*a* and 12*b* of the tie rod 12 are connected mechanically to the knuckles 6.

Expediently, two longitudinal stiffening ribs 13 are formed on the tie rod 12, at opposing major sides thereof.

The end 12*b* of the steering system tie rod 12 is of parallelepipedal box-type configuration open along a top side remote from the bodywork 1 and along a forward side facing said plane A.

Accoridng to this invention, the steering device 2 includes spring means 14 secured and operative between each of the opposing ends 12*a*, 12*b* of the tie rod 12 and is respective steering knuckle 6. Advantageously according to the invention, such spring means are comprised of two accordion-like spring members 14.

More specifically, each accordion-shaped spring member 14 includes two oppositely-directed bends or elbows, and is fast at one end with a respective cylindrical body 7, and at the other end, with a corresponding end, either 12*a* or 12*b*, of the tie rod 12.

It should be also noted that the cross-section area of the steering system tie rod 12 is greater than the cross-section area of the accordion-shaped spring members 14.

Advantageously according to a second preferred embodiment of the inventive steering device, the tie rod 12, spring members 14 of accordion-like configuration, and the steering knuckles 6 are a unitary construction molded from a synthetic plastics material.

The steering device 2 further includes a steering column extending across the plane A and set at an angle above the bodywork 1; the steering column 15 has a steering wheel 16 keyed to its top end 15*a*, the other, bottom end 15*b* of the steering column fitting into a socket 17 formed on the bodywork 1.

The steering column 15 lies close to the tie rod 12 and has a peg-like integral projection 18 which is arranged to project toward the bodywork 1 and is inserted into the end 12*b* of the steering system tie rod 12.

The steering column 15 with its peg-like projection 18 and the steering wheel 16 are also integral constructions molded from a synthetic plastics material.

The steering column 15 would be further supported, at a location proximate to the steering wheel 16, by parts of the toy car, known per se and omitted from the drawing.

The steering action of the steerable wheels 3 is obtained by turning the steering wheel 16 to rotate the steering column 15 and, hence, swinging the peg-like projection 18.

That projection 18, owing to its being engaged in the end 12*b* of the steering system tie rod 12, will impart to the tie rod 12 a translatory movement directed toward either steerable wheel 3 according to the direction in which the steering wheel 16 is turned.

As a result, the movement of the steering system tie rod 12, as stiffened by the ribs 13, will cause both accordion-like spring members 14 to deform elastically; in fact, whereas one spring member undergoes compression, the other spring member is simultaneously stretched. The spring members 14 will, in turn, cause the steering knuckles 6 journalled on the bodywork 1 and having the steerable wheels 3 associated therewith to pivot, and accordingly, develop the steering action sought.

On releasing the steering wheel 16, the wheels 3 will move back into their original positions under the bias force applied by the spring members 14 which tend to recover their starting equilibrium configuration.

The steering device of this invention has proved simple and economical to manufacture, and the operations involved in assembling its component parts to the toy car have been reduced in number and made easier.

Furthermore, the provision of accordion-shaped spring members between the steering system tie rod and the steering knuckles makes for a more robust and effective steering system, since the stresses developed by the steering action are advantageously divided over the entire accordion-shaped spring member, thus reducing considerably the likelihood of breakage failures.

I claim:

1. A steering device for toy cars comprising:

a steering system tie rod adapted to to extend transversely between opposite sides of a toy car and adapted to be connected to a steering means, and two spindles adapted to be pivotally mounted on a toy car for supporting respective wheels, each spindle being connected to a respective tie rod end by means of a respective accordion-shaped spring member, whereby upon assembly into a toy vehicle and upon movement of said tie rod by said steering means a turning moment will be applied to said spindles only through said spring members to turn said wheels and upon release of said steering means said spring members will bias said tie rod to a neutral position.

2. A steering device for toy cars as set forth in claim 1, wherein said tie rod, spring members and spindles are of a unitary one piece construction.

3. A steering device for toy cars as set forth in claim 1, wherein said tie rod has at least one longitudinal stiffening rib thereon.

* * * * *